US010851592B2

(12) United States Patent
Schroder et al.

(10) Patent No.: US 10,851,592 B2
(45) Date of Patent: Dec. 1, 2020

(54) MOVABLE CUTTERS AND DEVICES INCLUDING ONE OR MORE SEALS FOR USE ON EARTH-BORING TOOLS IN SUBTERRANEAN BOREHOLES AND RELATED METHODS

(71) Applicant: Baker Hughes, a GE company, LLC, Houston, TX (US)

(72) Inventors: Jon David Schroder, The Woodlands, TX (US); John Abhishek Raj Bomidi, Spring, TX (US); Kegan L. Lovelace, Houston, TX (US)

(73) Assignee: Baker Hughes, Houston, TX (US)

( * ) Notice: Subject to any disclaimer, the term of this patent is extended or adjusted under 35 U.S.C. 154(b) by 256 days.

(21) Appl. No.: 15/662,647

(22) Filed: Jul. 28, 2017

(65) Prior Publication Data

US 2019/0032408 A1 Jan. 31, 2019

(51) Int. Cl.

| | |
|---|---|
| ***E21B 10/25*** | (2006.01) |
| ***E21B 10/32*** | (2006.01) |
| ***E21B 10/46*** | (2006.01) |
| ***E21B 10/62*** | (2006.01) |
| ***E21B 10/573*** | (2006.01) |
| ***E21B 10/55*** | (2006.01) |

(52) U.S. Cl.

CPC ..... *E21B 10/25* (2013.01); *E21B 10/325* (2013.01); *E21B 10/46* (2013.01); *E21B 10/55* (2013.01); *E21B 10/573* (2013.01); *E21B 10/62* (2013.01)

(58) Field of Classification Search

CPC ..... E21B 10/08; E21B 10/50; E21B 10/52; E21C 35/197

See application file for complete search history.

(56) References Cited

U.S. PATENT DOCUMENTS

| | | | | |
|---|---|---|---|---|
| 3,945,681 | A | 3/1976 | White | |
| 4,542,942 | A * | 9/1985 | Zitz | E21C 35/187 299/81.2 |
| 4,553,615 | A | 11/1985 | Grainger | |
| 4,654,947 | A | 4/1987 | Davis | |
| 4,751,972 | A | 6/1988 | Jones et al. | |
| 7,604,073 | B2 | 10/2009 | Cooley et al. | |

(Continued)

FOREIGN PATENT DOCUMENTS

| | | |
|---|---|---|
| EP | 2143872 A1 | 1/2010 |
| GB | 2541812 A | 3/2017 |

(Continued)

OTHER PUBLICATIONS

International Written Opinion for International Application No. PCT/US2018/043602 dated Oct. 30, 2018, 11 pages.

(Continued)

*Primary Examiner* — David J Bagnell
*Assistant Examiner* — Dany E Akakpo
(74) *Attorney, Agent, or Firm* — TraskBritt

(57) ABSTRACT

A rotatable element for an earth-boring tool in a subterranean borehole includes a rotatable element and a stationary element. The rotatable element and stationary element include a seal arrangement between the rotatable element and the stationary element. The seal arrangement encloses a volume that remains substantially constant as the rotatable element moves relative to the stationary element.

21 Claims, 6 Drawing Sheets

(56) References Cited

U.S. PATENT DOCUMENTS

| | | | | |
|---|---|---|---|---|
| 7,703,559 | B2 | 4/2010 | Shen et al. | |
| 7,762,359 | B1 | 7/2010 | Miess | |
| 7,845,436 | B2 | 12/2010 | Cooley et al. | |
| 7,987,931 | B2 | 8/2011 | Cooley et al. | |
| 8,061,452 | B2 | 11/2011 | Cooley et al. | |
| 8,079,431 | B1 | 12/2011 | Cooley et al. | |
| 8,091,655 | B2 | 1/2012 | Shen et al. | |
| 8,210,285 | B2 | 7/2012 | Cooley et al. | |
| 8,413,746 | B2 | 4/2013 | Shen et al. | |
| 8,561,728 | B2 | 10/2013 | Cooley et al. | |
| 8,590,627 | B2 | 11/2013 | Jin et al. | |
| 8,800,691 | B2 | 8/2014 | Shen et al. | |
| 8,881,849 | B2 | 11/2014 | Shen et al. | |
| 8,931,582 | B2 | 1/2015 | Cooley et al. | |
| 8,950,516 | B2 | 2/2015 | Newman | |
| 8,973,684 | B1 | 3/2015 | Cooley et al. | |
| 8,991,523 | B2 | 3/2015 | Shen et al. | |
| 9,016,409 | B2 | 4/2015 | Zhang et al. | |
| 9,033,070 | B2 | 5/2015 | Shen et al. | |
| 9,091,132 | B1 | 7/2015 | Cooley et al. | |
| 9,187,962 | B2 | 11/2015 | Burhan et al. | |
| 9,279,294 | B1 | 3/2016 | Cooley et al. | |
| 9,284,790 | B2 | 3/2016 | Zhang et al. | |
| 9,291,000 | B2 | 3/2016 | Zhang et al. | |
| 9,322,219 | B2 | 4/2016 | Burhan et al. | |
| 9,328,564 | B2 | 5/2016 | Zhang et al. | |
| 9,382,762 | B2 | 7/2016 | Cooley et al. | |
| 9,388,639 | B2 | 7/2016 | Patel et al. | |
| 9,464,486 | B2 | 10/2016 | Zhang et al. | |
| 9,605,486 | B2 | 3/2017 | Burhan et al. | |
| 9,624,731 | B2 | 4/2017 | Haugvaldstad et al. | |
| 9,803,427 | B1 | 10/2017 | Colley et al. | |
| 9,920,579 | B2 | 3/2018 | Newman | |
| 10,267,096 | B2 | 4/2019 | Burhan et al. | |
| 2007/0137899 | A1 | 6/2007 | Beccu | |
| 2008/0035386 | A1 | 2/2008 | Hall et al. | |
| 2008/0251293 | A1 | 10/2008 | Mumma et al. | |
| 2010/0314176 | A1 | 12/2010 | Zhang et al. | |
| 2011/0017514 | A1* | 1/2011 | Anderele | E21B 10/24 175/229 |
| 2012/0234609 | A1 | 9/2012 | Cooley et al. | |
| 2012/0273281 | A1 | 11/2012 | Burhan et al. | |
| 2012/0318580 | A1* | 12/2012 | Oesterberg | E21B 7/064 175/57 |
| 2013/0098688 | A1* | 4/2013 | Yong | E21B 10/22 175/227 |
| 2014/0054094 | A1 | 2/2014 | Burhan et al. | |
| 2014/0131118 | A1 | 5/2014 | Chen et al. | |
| 2014/0246246 | A1 | 9/2014 | Radford | |
| 2014/0271008 | A1 | 9/2014 | Sweetman et al. | |
| 2014/0326515 | A1 | 11/2014 | Shi et al. | |
| 2014/0326516 | A1 | 11/2014 | Haugvaldstad et al. | |
| 2014/0345951 | A1 | 11/2014 | Shen et al. | |
| 2014/0360789 | A1 | 12/2014 | Siracki et al. | |
| 2014/0360792 | A1 | 12/2014 | Azar et al. | |
| 2015/0047910 | A1 | 2/2015 | Chen et al. | |
| 2015/0129310 | A1 | 5/2015 | Newman | |
| 2015/0266088 | A1 | 9/2015 | Shimizu et al. | |
| 2016/0290056 | A1 | 10/2016 | Propes et al. | |
| 2017/0036269 | A1 | 2/2017 | Lim et al. | |
| 2017/0100756 | A1 | 4/2017 | Hewitt | |
| 2017/0191317 | A1 | 7/2017 | Burhan et al. | |
| 2019/0078393 | A1 | 3/2019 | Moss et al. | |

FOREIGN PATENT DOCUMENTS

| | | | |
|---|---|---|---|
| WO | 2012/149120 | A2 | 11/2012 |
| WO | 2014/078683 | A1 | 5/2014 |
| WO | 2015/023953 | A1 | 2/2015 |
| WO | 2016/018204 | A1 | 2/2016 |

OTHER PUBLICATIONS

International Search Report for International Application No. PCT/US2018/043602 dated Oct. 30, 2018, 9 pages.

Moss et al., U.S. Appl. No. 15/662,626 titled Rotatable Cutters and Elements for Use on Earth-Boring Tools in Subterranean Boreholes, Earth-Boring Tools Including Same, and Related Methods, filed Jul. 28, 2017.

Moss et al., U.S. Appl. No. 15/704,955, filed Sep. 14, 2017 and titled Earth-Boring Tools Including Rotatable Cutting Element Assemblies and Related Methods of Forming and Using the Same.

Schroder et al., U.S. Appl. No. 15/810,412, filed Nov. 13, 2017 and titled Methods of Forming Stationary Elements of Rotatable Cutting Elements for Use on Earth-Boring Tools and Stationary Elements Formed Using Such Methods.

* cited by examiner

MOVABLE CUTTERS AND DEVICES INCLUDING ONE OR MORE SEALS FOR USE ON EARTH-BORING TOOLS IN SUBTERRANEAN BOREHOLES AND RELATED METHODS

TECHNICAL FIELD

Embodiments of the present disclosure generally relate to movable elements, cutters, and devices for use with earth-boring (e.g., downhole) tools. In particular, to movable elements, cutters, and devices including at least one movable section and one or more seals.

BACKGROUND

Various earth-boring tools such as rotary drill bits (including roller cone bits and fixed-cutter or drag bits), core bits, eccentric bits, bicenter bits, reamers, and mills are commonly used in forming bore holes or wells in earth formations. Such tools often may include one or more cutting elements on a formation-engaging surface thereof for removing formation material as the earth-boring tool is rotated or otherwise moved within the borehole.

For example, fixed-cutter bits (often referred to as "drag" bits) have a plurality of cutting elements affixed or otherwise secured to a face (i.e., a formation-engaging surface) of a bit body. Cutting elements generally include a cutting surface, where the cutting surface is usually formed out of a superabrasive material, such as mutually bound particles of polycrystalline diamond. The cutting surface is generally formed on and bonded to a supporting substrate of a hard material such as cemented tungsten carbide. During a drilling operation, a portion of a cutting edge, which is at least partially defined by the peripheral portion of the cutting surface, is pressed into the formation. As the earth-boring tool moves relative to the formation, the cutting element is dragged across the surface of the formation and the cutting edge of the cutting surface shears away formation material. Such cutting elements are often referred to as "polycrystalline diamond compact" (PDC) cutting elements, or cutters.

During drilling, cutting elements are subjected to high temperatures due to friction between the cutting surface and the formation being cut, high axial loads from the weight on bit (WOB), and high impact forces attributable to variations in WOB, formation irregularities and material differences, and vibration. These conditions can result in damage to the cutting surface (e.g., chipping, spalling). Such damage often occurs at or near the cutting edge of the cutting surface and is caused, at least in part, by the high impact forces that occur during drilling. Damage to the cutting element results in decreased cutting efficiency of the cutting element. When the efficiency of the cutting element decreases to a critical level the operation must be stopped to remove and replace the drill bit. Replacing the drill bit can be a large expense for an operation utilizing earth-boring tools.

Securing a PDC cutting element to a drill bit restricts the useful life of the cutting element. The cutting edge of the diamond table wears down as does the substrate. A so-called "wear flat" is created necessitating increased weight on bit to maintain a given rate of penetration of the drill bit into the formation due to the increased surface area presented. In addition, unless the cutting element is heated to remove it from the bit and then rebrazed with an unworn portion of the cutting edge presented for engaging a formation, more than half of the cutting element is never used.

Attempts have been made to configure cutting elements to rotate such that a majority of the cutting edge extending around each cutting element may selectively engage with and remove material. By utilizing a majority of the cutting edge, the effective life of the cutting element may be increased. Some designs utilize mechanisms and/or bearings to allow the cutting element to turn by displacing the cutting element linearly with respect to the longitudinal axis of the cutting element to engage or disengage an index positioning feature, or to float and allow free rotation. Additionally, some cutting elements displace linearly on devices such as reamers to control the width of the borehole. The ingress of debris and fluid, inherent in boreholes, into the cutting elements can damage the internal components hindering movement of the cutting element.

BRIEF SUMMARY

In some embodiments, the present disclosure includes a rotatable cutter for use on an earth-boring tool in a subterranean borehole. The rotatable cutter may comprise a rotatable element, a stationary element, and at least one seal between the rotatable element and the stationary element. The at least one seal may be configured to maintain a substantially constant sealed volume defined between the rotatable element and the stationary element. The substantially constant sealed volume may be configured to contain a fluid.

In additional embodiments, the present disclosure includes an earth-boring tool comprising a tool body and elements carried by the tool body. At least one element of the elements may comprise a movable element, a sleeve element, and a seal arrangement between the movable element and the sleeve element. The movable element may be configured to engage a portion of the subterranean borehole. The seal arrangement may be configured to define and maintain a substantially constant volume. The substantially constant volume may be configured to enclose a lubricating fluid.

Further embodiments of the present disclosure include a method of sealing a rotatable cutter on an earth-boring tool for use in a subterranean borehole. The method may comprise disposing an inner cutting element at least partially within an outer sleeve. The inner cutting element may comprise a cutting surface and a support structure. The method may further comprise translating the inner cutting element between a first axial position and a second axial position along a longitudinal axis of the rotatable cutter. A sealing arrangement may be used for defining a substantially constant volume between the rotatable element and the stationary element.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular earth-boring tool, rotatable cutting element or component thereof, but are merely idealized representations employed to describe illustrative embodiments. The drawings are not necessarily to scale.

The embodiments disclosed relate generally to rotatable or otherwise movable devices or elements (e.g., rotatable cutting elements) for earth-boring tools that may move in order to alter the positioning of the cutting element relative to an earth-boring tool to which the cutting element is coupled. For example, such a configuration may enable the cutting element to present a continuously sharp cutting edge with which to engage a downhole formation while still occupying substantially the same amount of space as conventional fixed cutting elements. Embodiments of the disclosure include a seal or seal assembly that is positioned between movable device (e.g., stationary element and a rotatable element). The seal or seal assembly may be configured to at least partially isolate and/or contain a volume within the movable device. Such seals or seal assemblies may also be utilized to provide a seal for cutting elements that do not rotate but are otherwise displaced (e.g., linearly along the longitudinal axis of the cutting element) relative to the structure to which they are secured.

Movable devices and elements may be implemented in a variety of earth-boring tools, such as, for example, rotary drill bits, percussion bits, core bits, eccentric bits, bicenter bits, reamers, expandable reamers, mills, drag bits, roller cone bits, hybrid bits, and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Figure 1:
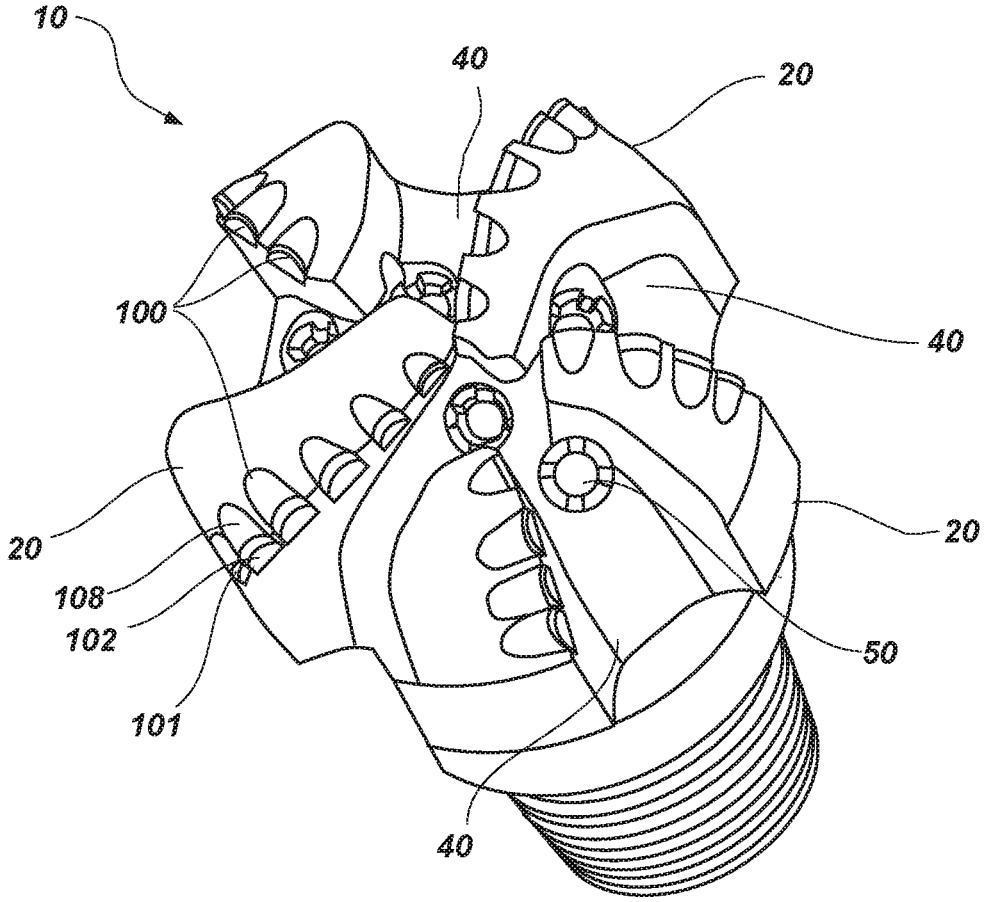
FIG. 1 illustrates a fixed cutter earth-boring tool commonly known as a "drag-bit," in accordance with an embodiment of the present disclosure.

Referring to FIG. 1, a perspective view of an earth-boring tool 10 is shown. The earth-boring tool 10 may have blades 20 in which a plurality of cutting elements 100 may be secured. The cutting elements 100 may have a cutting table 101 with a cutting surface 102, which may form the cutting edge of the blade 20. The earth-boring tool 10 may rotate about a longitudinal axis of the earth-boring tool 10. When the earth-boring tool 10 rotates the cutting surface 102 of the cutting elements 100 may contact the earth formation and remove material. The material removed by the cutting surfaces 102 may then be removed through junk slots 40. The earth-boring tool 10 may include nozzles 50 that may introduce drilling fluid, commonly known as drilling mud, into the area around the blades 20 to aid in removing the sheared material and other debris from the area around the blades 20 to increase the efficiency of the earth-boring tool 10.

In an application where the cutting elements 100 are fixed, only the edge of the cutting surface 102 of the cutting element 100 that is exposed will contact the earth formation and wear down during use. By rotating the cutting element 100, relatively more of (e.g., a majority of, a substantial entirety of) the entire edge of the cutting surface 102 may be exposed to wear and may act to extend the life of the cutting element 100.

In some embodiments, the rotatable devices and elements disclosed herein may be somewhat similar to those described in, for example, U.S. patent application Ser. No. 15/662,626, filed on even date herewith and titled "ROTATABLE CUTTERS AND ELEMENTS FOR USE ON EARTH-BORING TOOLS IN SUBTERRANEAN BOREHOLES AND RELATED METHODS," the disclosure of which is incorporated herein in its entirety by this reference.

Figure 2:
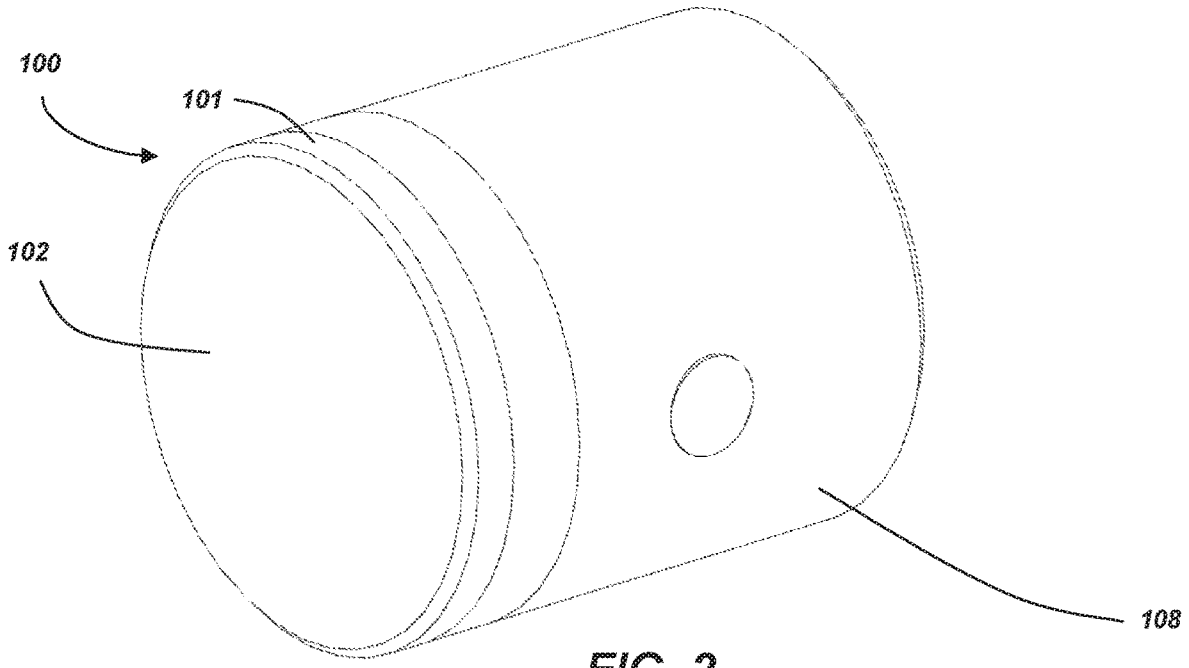
FIG. 2 is an isometric view of a rotatable cutter in accordance with an embodiment of the present disclosure.

Referring to FIG. 2, a perspective view of an embodiment of a rotatable cutter 100 is shown. The rotatable cutter 100 may comprise the cutting table 101 with the cutting surface 102 and a substrate 108. The cutting table 101 may be formed from a polycrystalline material, such as, for example, polycrystalline diamond or polycrystalline cubic boron nitride. The rotatable cutter 100 may be secured to the earth-boring tool 10 by fixing the exterior surface of the substrate 108 to the earth-boring tool 10 (FIG. 1). This is commonly achieved through a brazing process.

Figure 3:
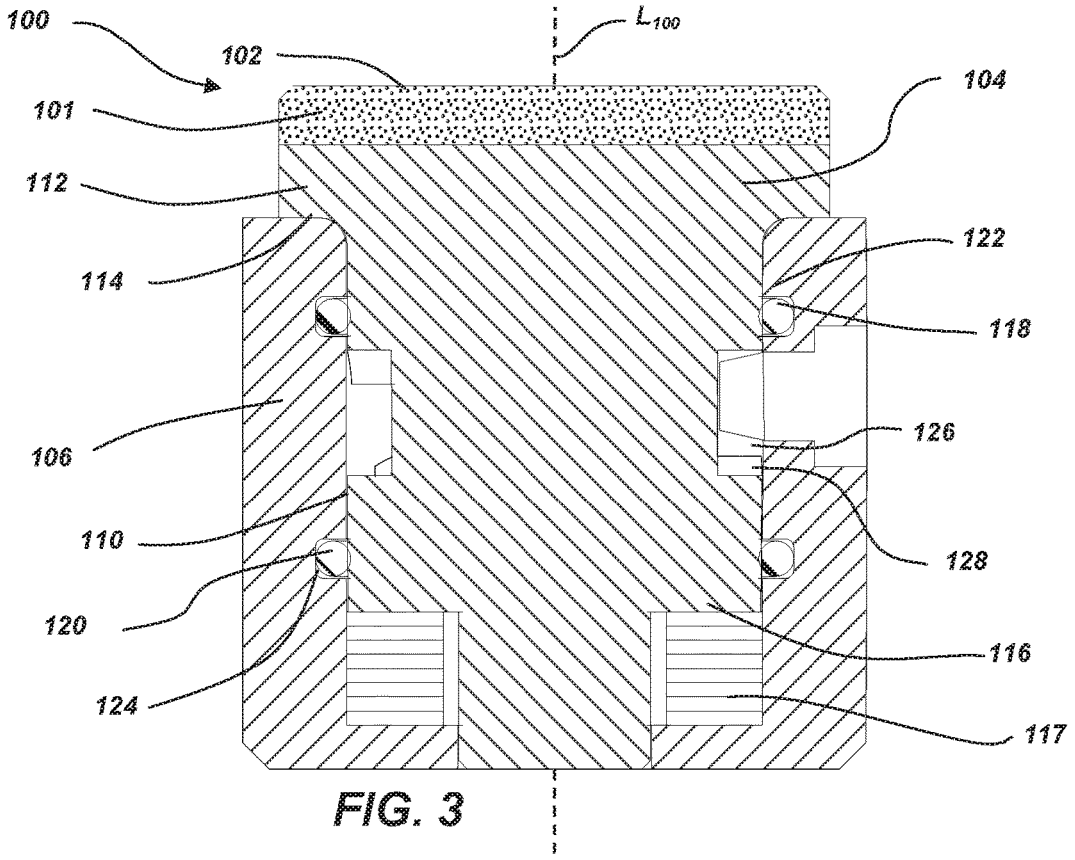
FIG. 3 a cross-sectional side view of a rotatable cutter in a first position in accordance with an embodiment of the present disclosure.

Referring to FIG. 3, a cross-sectional side view of an embodiment of the rotatable cutter 100 is shown. To enable the cutting surface 102 to move (e.g., rotate), the substrate 108 of the rotatable cutter 100 may be separated into multiple parts, for example, an inner cutting element (e.g., a rotatable element 104) and an outer element (e.g., a stationary element 106). The stationary element 106 may define the exterior surface of the substrate 108. A cavity 110 in the stationary element 106 may be configured to receive the rotatable element 104. In some embodiments, the rotatable element 104 may be disposed at least partially within the cavity 110. One or more portions of the substrate 108 may be formed from a hard material suitable for use in a subterranean borehole, such as, for example, a metal, an alloy (e.g., steel), a ceramic-metal composite material (e.g., cobalt-cemented tungsten carbide), or combinations thereof.

The rotatable element 104 may comprise a cutting surface 102 over a support structure 112. The cutting surface 102 may be configured to engage a portion of a subterranean borehole. In some embodiments, the rotatable element 104 may be sized and configured such that the cutting surface 102 is at least the same diameter as the stationary element 106. In some embodiments, the support structure 112 may include a shoulder 114. The shoulder 114 may rest against the stationary element 106, for example, when the cutting surface 102 is engaged with the subterranean borehole. The lower portion of the support structure 112 may be a smaller diameter than the diameter of the cavity 110 in the stationary element 106 to facilitate being at least partially disposed within the stationary element 106.

Figure 4:
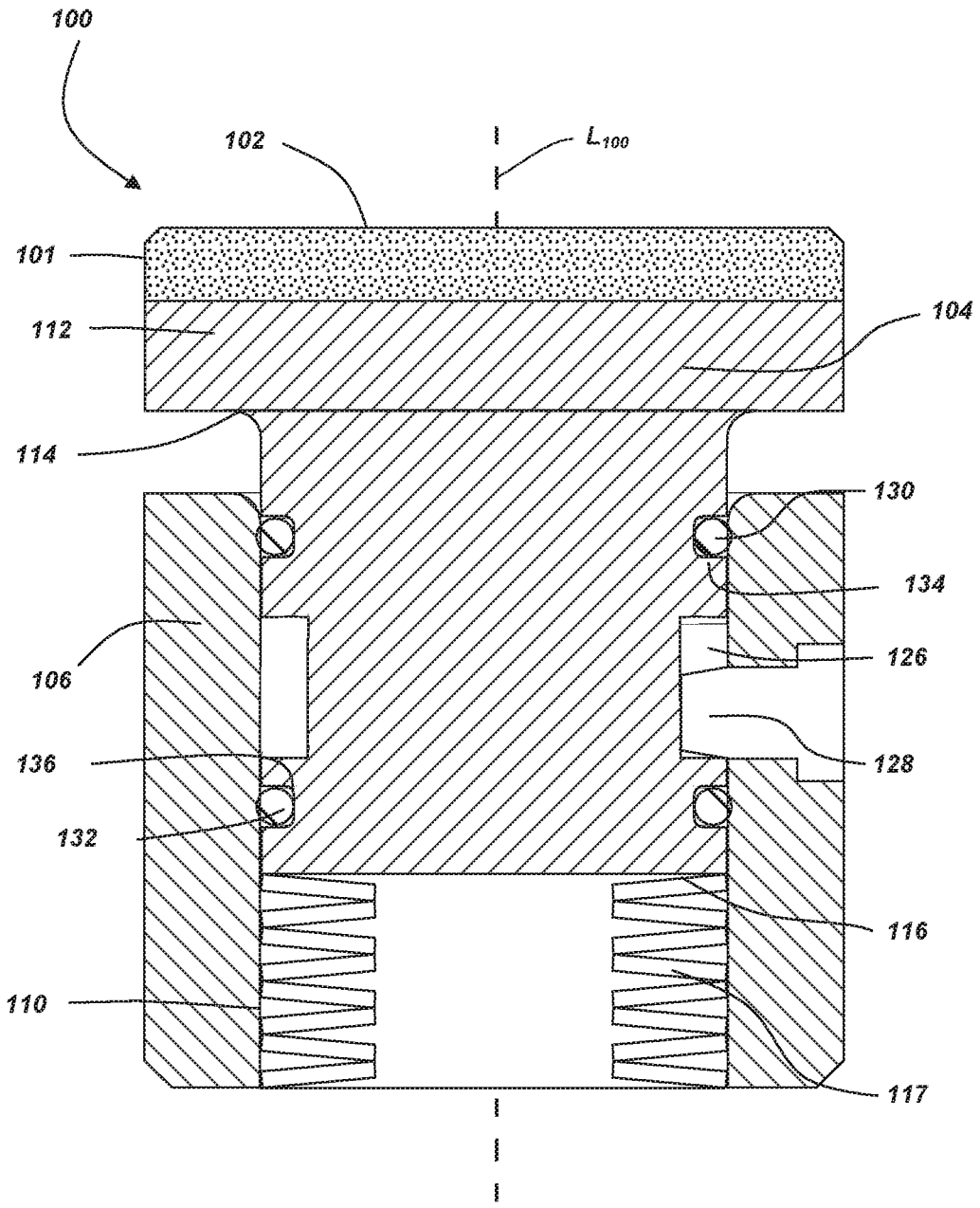
FIG. 4 a cross-sectional side view of a rotatable cutter in a second position in accordance with an embodiment of the present disclosure.

The rotatable element 104 may be configured to rotate about and move along (e.g., move linearly along) the longitudinal axis $L_{100}$ of the rotatable cutter 100 relative to the stationary element 106. There may be a slight space between the rotatable element 104 and the stationary element 106 to enable this movement. In some embodiments, the rotatable element 104 may move between a first axial position (e.g., a compressed position as shown in FIG. 3) and a second axial position (e.g., an expanded position as shown in FIG. 4).

In some embodiments, an index positioning feature 128 may be implemented to control movement of the rotatable cutter 100. For example, the index positioning feature 128 may be implemented to rotate the rotatable element 104 and to control that rotation. An exemplary index positioning feature 128 is detailed, for example, in the above-referenced U.S. patent application Ser. No. 15/662,626. The rotatable element 104 may move along the longitudinal axis $L_{100}$ of the rotatable cutter 100 between the first axial position and the second axial position. The index positioning feature 128 may act as a stop preventing the rotatable element 104 from moving beyond the first axial position or the second axial position. The index positioning feature 128 may, at least partially inhibiting the rotation of the rotatable element 104 relative to the stationary element 106 when the rotatable element 104 is positioned at the first axial position and/or the second axial position. As the rotatable element 104 moves from the first axial position to the second axial position, the index positioning feature 128 may impart a force on the rotatable element 104 causing the rotatable element 104 to rotate (e.g., a select amount of degrees) relative to the stationary element 106. Similarly, the index positioning feature 128 may also impart rotation on the rotatable element 104 as the rotatable element 104 moves from the second axial position to the first axial position.

In some embodiments, a biasing element 117 may be disposed between a base 116 of the rotatable element 104 and the stationary element 106. The biasing element 117 may be configured to bias the rotatable element 104 in the first axial position (e.g., the compressed position) in a direction away from the stationary element 106. The biasing element 117 may assist in translating the rotatable element 104 between the first axial position (e.g., compressed position) and the second axial position (e.g., expanded position) along the longitudinal axis $L_{100}$ of the cutting element 100. Examples of biasing elements that may be used, by way of example but not limitation, are springs, washers (e.g., Bellville washers), compressible fluids, magnetic biasing, resilient materials, or combinations thereof.

Referring still to FIG. 3, a seal arrangement is disposed between the rotatable element 104 and the stationary element 106. For example, the seal arrangement may comprise one or more seals (e.g., two seals 118, 120) positioned between the rotatable element 104 and stationary element 106. In some embodiments, the seals 118, 120 may be radial seals having at least a partially annular shape. In some embodiments, the seals 118, 120 may be constructed of, for example, a polymer, elastomer, or other similar material which is capable of withstanding the pressures and temperatures inherent in the downhole environment.

The seals 118, 120 may be configured to maintain a substantially constant sealed volume 126 (e.g., a substantially incompressible fluid). For example, the substantially constant sealed volume 126 may be defined between the rotatable element 104 and the stationary element 106. The substantially constant sealed volume 126 may be defined by a first seal 118 (e.g., top seal) positioned along the longitudinal axis $L_{100}$ at a first location proximate the cutting surface 102 of the rotatable element 104 and a second seal 120 (e.g., bottom seal) positioned at a second location positioned relatively further away from the cutting surface 102 of the rotatable element 104. In some embodiments, the first seal 118 and the second seal 120 may both be at least partially fixed to the same element. The first seal 118 and second seal 120 may also have substantially the same diameter. In additional embodiments, the seal arrangement may comprise more than two seals.

As depicted in FIG. 3, the stationary element 106 may have seal seats 122, 124 disposed within the stationary element 106. The first seal 118 and the second seal 120 may both be associated primarily with the stationary element 106 in the respective seats 122, 124. For example, both the first seat 122, and second seat 124 may be positioned on or at least partially within the stationary element 106. The seals 118, 120 in the stationary element 106 are configured such that the distance between the first seal 118 and the second seal 120 remains substantially constant as the rotatable element 104 moves relative to the stationary element 106 (e.g., in order to maintain a substantially constant volume defined between the seals 118, 120 and the open volume between the rotatable element 104 and the stationary element 106). The seats 122, 124 may be radially sized such that the first seat 122 and the second seat 124 are substantially the same diameter.

In some embodiments, the seal seats 122, 124 may be disposed within an inner portion of the stationary element 106 that is separate from or integral with the remaining outer portion of the stationary element 106 (e.g., an inner sleeve).

As discussed above, some embodiments may include an index positioning feature 128 positioned between the rotatable element 104 and stationary element 106. In some embodiments, the index positioning feature 128 may rotate the rotatable element 104 relative to the stationary element 106 when the rotatable element 104 is moved from a first axial position (e.g., compressed position), shown in FIG. 3, toward a second axial position (e.g., expanded position), shown in FIG. 4, and when the rotatable element 104 is moved from the second axial position toward the first axial position. As discussed above, the index positioning feature 128 may have components that interact between the stationary element 106 and the rotatable element 104. The components may rotate the rotatable element 104 as the rotatable element 104 is translated between the compressed position and the expanded position. In some embodiments, the components may also impede rotation when the rotatable element 104 is in at least one of the compressed position and the expanded position. In embodiments which include an index positioning feature 128, the seal arrangement may be configured to seal at least a majority of the index positioning feature 128 within the substantially constant sealed volume 126.

As the rotatable element 104 moves from the compressed position to the expanded position, the volume enclosed between the first seal 118 and the base 116 of the rotatable element 104 may increase as the body of the rotatable element 104 moves out of the cavity 110. Similarly, as the rotatable element 104 moves from the expanded position to the compressed position the volume enclosed between the first seal 118 and the base 116 of the rotatable element 104 may decrease as the body of the rotatable element 104 moves into the cavity 110. The second seal 120 may isolate the constant sealed volume 126 from the total volume enclosed by the first seal 118 and the base 116 of the rotatable element 104. Thus, the seal arrangement may maintain the constant sealed volume 126 between the first seal 118 and the second seal 120 as the rotatable element 104 moves between the first axial position and the second axial position.

Referring to FIG. 4, a cross-sectional view of an embodiment of a rotatable cutter in a second axial position (e.g., expanded position) is shown. In some embodiments, the seal arrangement (e.g., seals 130, 132) may be associated primarily with the rotatable element 104. For example, the seals 130, 132 may be positioned in the rotatable element 104 in seal seats 134, 136. As above, the distance between the first seal 130 and the second seal 132 may remain substantially constant as the rotatable element 104 moves relative to the stationary element 106. The first seal seat 134 and the second seal seat 136 may both be positioned such that they are substantially the same diameter.

As shown in FIG. 4, the biasing element 117 may expand, translating the rotatable element 104 along the longitudinal axis $L_{100}$ of the rotatable cutter 100 from the first axial position to the second axial position. In some embodiments, the first and second axial positions may be limited by an index positioning feature 128 as described above.

In some embodiments, the substantially constant sealed volume 126 may contain a substantially incompressible fluid. In some embodiments, the fluid enclosed by the seal arrangement may be a lubricating fluid (e.g., oil or grease). The lubricating fluid may be used for lubricating at least one inner component of the rotatable cutting element 100.

Figure 5:
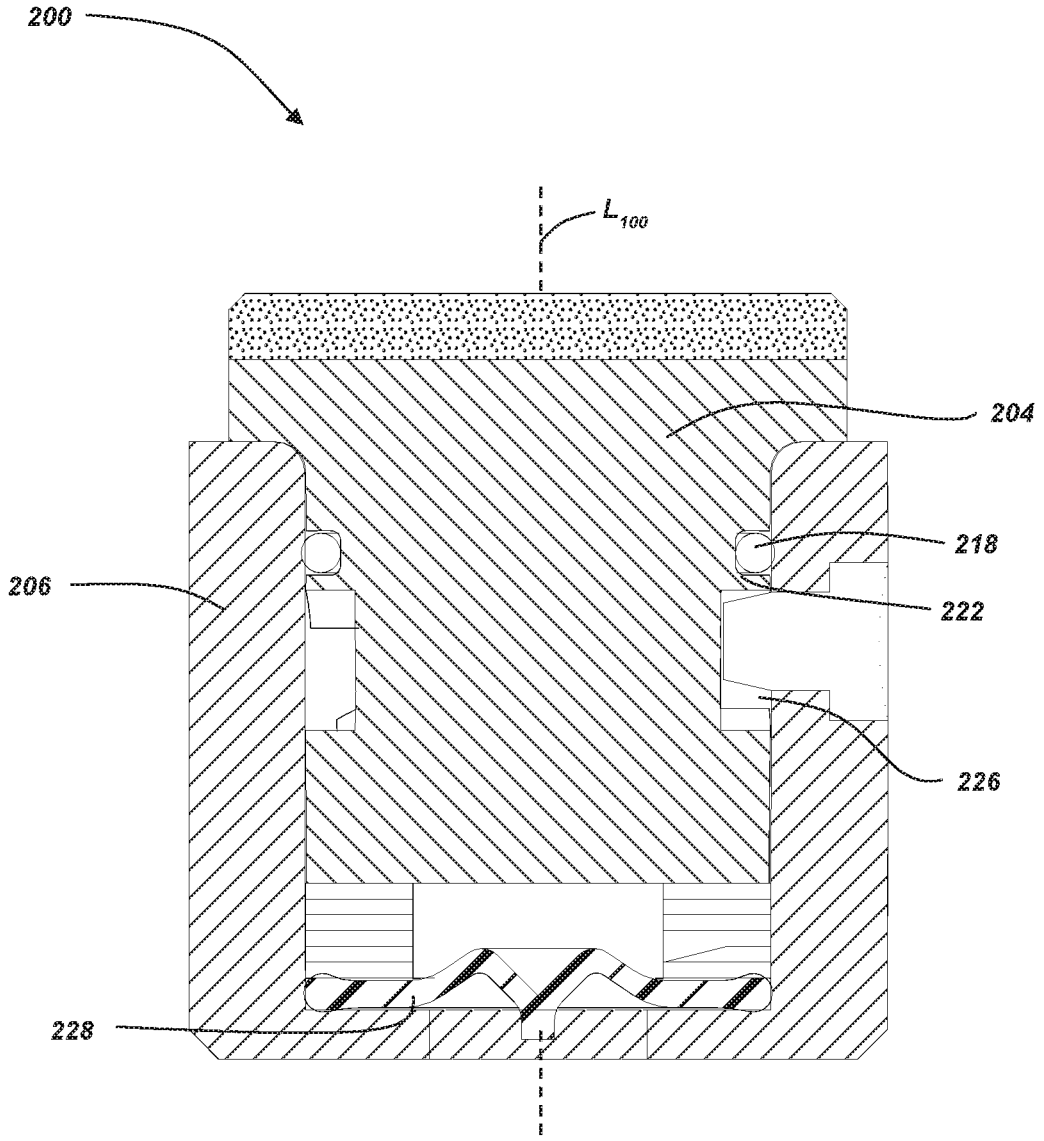
FIG. 5 a cross-sectional side view of a rotatable cutter in accordance with an embodiment of the present disclosure.

Referring to FIG. 5, a cross-sectional side view of another embodiment of the rotatable cutter 200 is shown. In some embodiments, the seal arrangement may comprise a fixed seal 218 in a seat 222 in one of a stationary element 206 or a rotatable element 204, and an expandable seal 228 coupled to both the stationary element 206 and the rotatable element 204. The rotatable element 204 may move along the longitudinal axis $L_{100}$ of the rotatable cutter 200. The expandable seal 228 may maintain the substantially constant volume 226 as the rotatable element 204 moves relative to the stationary element 206 or stationary element 206. In some embodiments, the fixed seal 218 may be positioned similarly to the first seal 118 of the embodiment of FIG. 3. In other embodiments, the fixed seal 218 may be positioned similar to the first seal 130 of the embodiment of FIG. 4, as shown in FIG. 5. In additional embodiments, there may be a plurality of fixed seals and/or a plurality of expandable seals configured in differing combinations.

As depicted, an expandable seal 228 may comprise a diaphragm extending between and fixed to the stationary element 206 or the rotatable element 204. The expandable seal 228 may comprise a resilient material. The expandable seal 228 may expand or compress in order to maintain a substantially constant sealed volume 226 defined by the fixed seal 218, the expandable seal 228, the rotatable element 204, and the stationary element 206.

Figure 6:
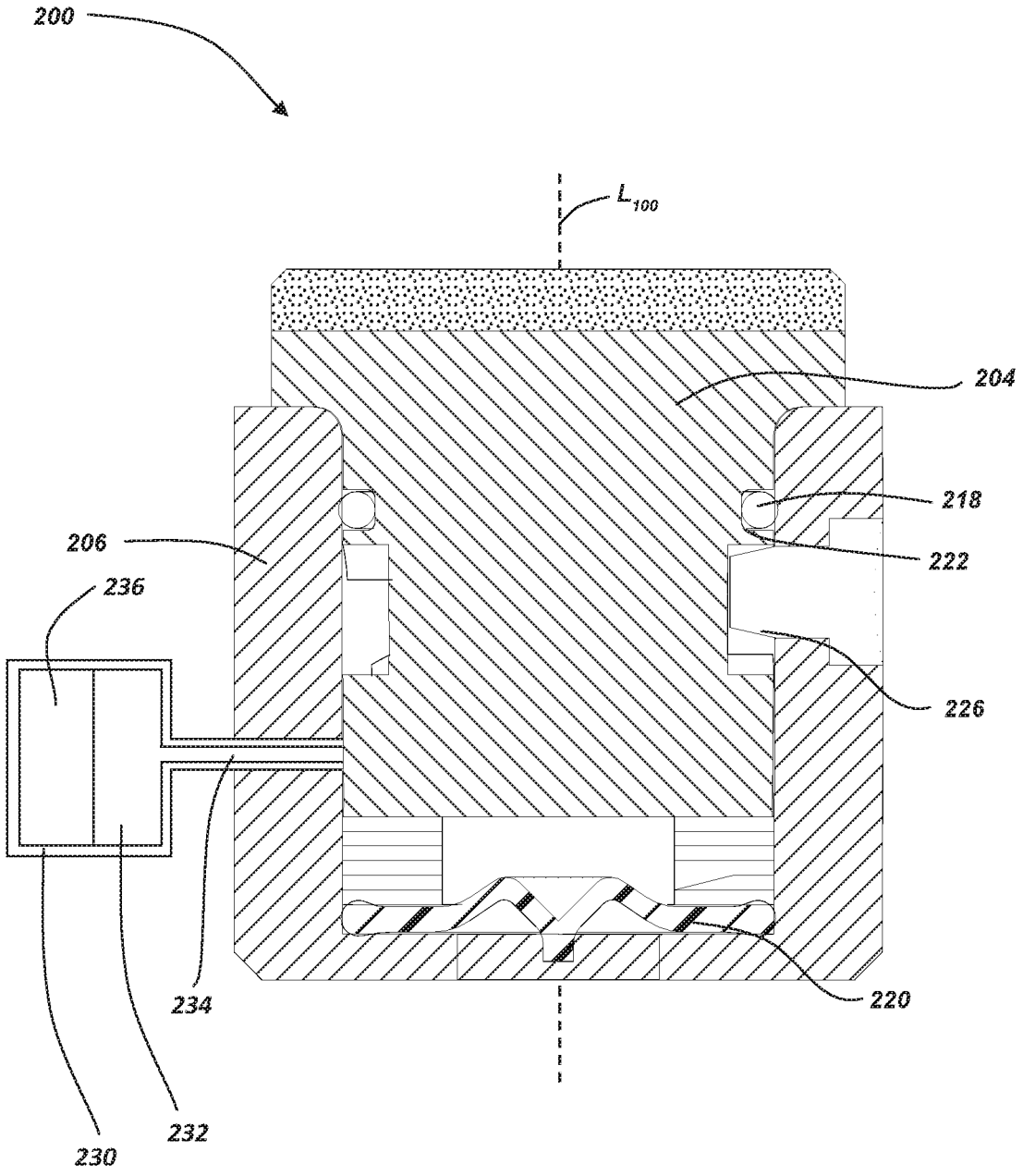
FIG. 6 a cross-sectional side view of a rotatable cutter in accordance with an embodiment of the present disclosure.

Referring to FIG. 6, a cross-sectional side view of another embodiment of the rotatable cutter 200 is shown. In some embodiments, an expansion tank 230 may be used to maintain the constant sealed volume 226. The expansion tank 230 may utilize an external fluid reservoir 232 in addition to or as an alternative of a second seal 220 (e.g., the expandable seal, as depicted, seals 120, 132, etc.). The external fluid reservoir 232 may comprise at least one feature 236 (e.g., a piston, or an expansion bladder) in fluid communication with the substantially constant sealed volume 226. The fluid communication may occur through a connection 234 (e.g., a port, tube, or pipe) between the external fluid reservoir 232 and the substantially constant sealed volume 226. In some embodiments, the feature 236 of the external fluid reservoir 232 may be configured to maintain the substantially constant sealed volume 226 when the rotatable element 204 moves relative to the stationary element 206.

Some embodiments, using an external fluid reservoir 232, may position the first seal 218 on the opposite element from the second seal 220. The external fluid reservoir 232 may compensate for the change in distance between the first seal 218, and second seal 220, when the rotatable element 204 moves relative to the stationary element 206. Similarly, in other embodiments, the first seal 218 and the second seal 220 may have different diameters. The external fluid reservoir 232 may be used to maintain the constant sealed volume 226 by compensating for the volumetric change that may occur absent the external fluid reservoir 232 when the rotatable element 204 moves relative to the stationary element 206.

Figure 7:
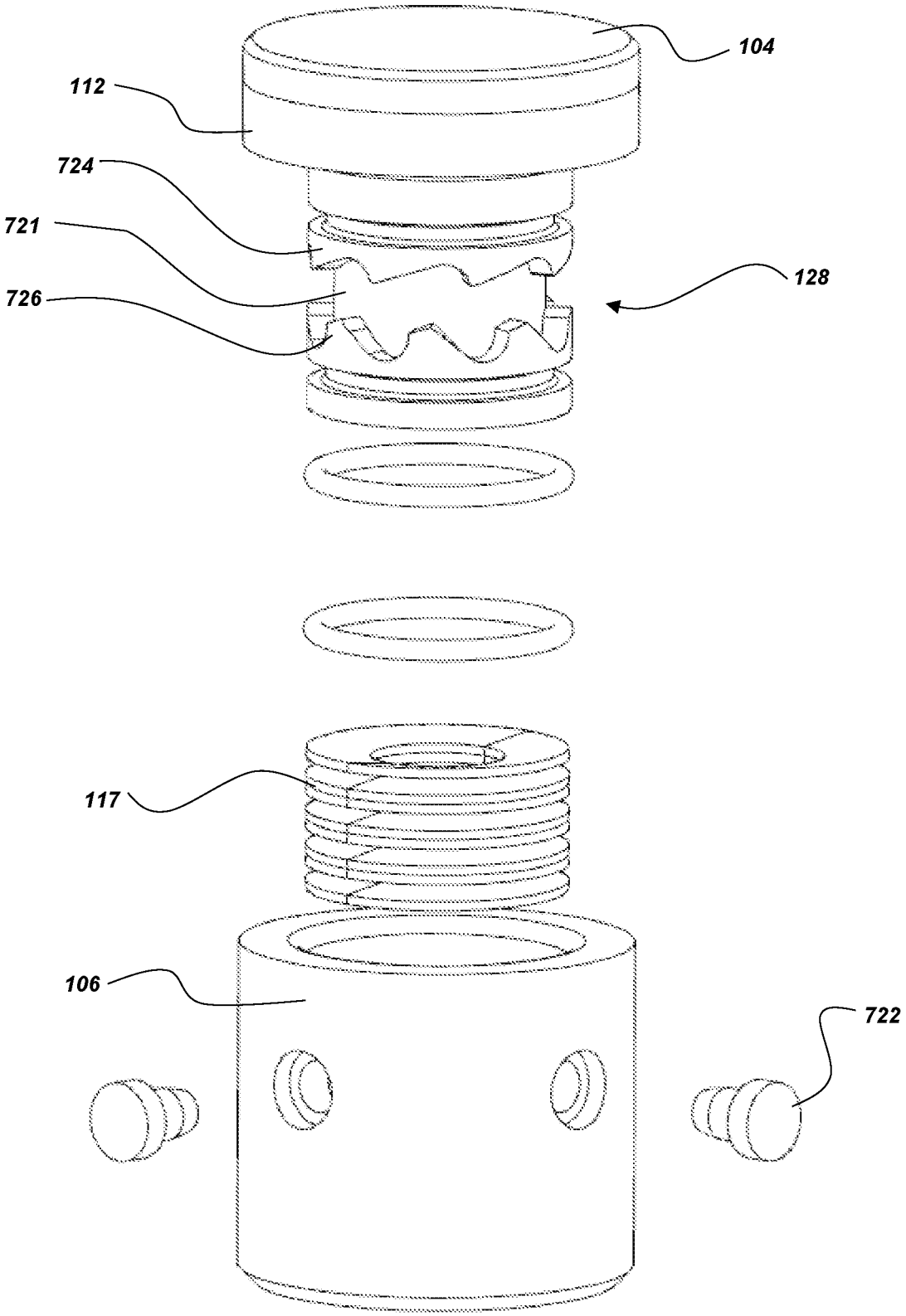
FIG. 7 is an exploded view of the embodiment shown in FIGS. 3 and 4.

FIG. 7 is an exploded view of the embodiment shown in FIGS. 3 and 4. Referring to FIGS. 3, 4, and 7, the index positioning feature 128 may comprise one or more protrusions (e.g., pin 722) and one or more tracks 721. For example, the track 721 may be defined in the rotatable element 104 by one or more track portions 724, 726 (e.g., undulating upper and lower track portions 724, 726 including protrusions and recesses positioned on each longitudinal side of the track 721). The engagement of the pins 722 in the track 721 may be configured to rotate the rotatable element 104 relative to the stationary element 106 when the rotatable element 104 is moved toward the second axial position or toward the first axial position. As depicted, the offset peaks and valleys in each track portion 724, 726 enable the pins 722, in conjunction with the forced axial movement of the rotatable element 104 (e.g., due to external forces and/or the force of the biasing element 117), to slide on one of the track portions 724, 726 in order to rotate the rotatable element 104. In some embodiments, the pins 722 may be positioned on the stationary element 106 and the track 721 may be defined on the support structure 112 of the rotatable element 104. In some of these embodiments, the pins 722 may comprise at least two pins 722 arranged about (e.g., around) the longitudinal axis $L_{100}$. As depicted, the track 721 may be recessed into a portion of the rotatable element 104 as shown in FIG. 7. In some embodiments, the track 721 may protrude from the rotatable element 104 with pins 722 following outer surfaces of the track 721.

Earth-boring tools are typically used at the end of a drill string. Drill strings are built out of sections of pipe typically 31 to 46 feet in length. The sections of pipe are connected end to end to create long drill strings which can reach lengths in excess of 40,000 feet. When an earth-boring tool fails the drill string must be removed from the borehole, one 31 to 46 foot section at a time, until the end of the drill string is accessible to change the earth-boring tool or replace the worn or damaged cutters. Changing an earth-boring tool, or tripping out the earth-boring tool to replace worn or damaged cutters, represents a large amount of time and a great expense. Improvements to the cutters on an earth-boring tool which extend the life of the tool represent a large cost savings to downhole earth boring operations.

The downhole environment includes drilling mud introduced by the nozzles as well as material and debris removed by the cutters. Additionally, there may be pressures in excess of 2,000 PSI downhole. The debris and drilling mud could potentially enter the space between the rotatable element and the stationary element. If debris and/or drilling mud enters the space between the rotatable element and the stationary element, it may result in damage to bearings and other moving parts within the rotatable cutter. This damage may interfere with the rotation of the rotatable element, which may nullify the advantages of a rotatable cutter. Additionally, the damage could cause vibration to occur within the rotatable cutter during operation, which could also cause premature failure of the rotatable cutter.

Embodiments of rotatable cutters described herein may improve the serviceable life of the rotatable cutters. Rotatable cutters may experience undue wear to internal components due to the ingress of debris and fluid inherent in downhole earth boring operations. The undue wear may result in premature failure of the rotatable cutter. Sealing the rotatable cutter may inhibit the ingress of debris and fluid to the internal components of the rotatable cutters. Preventing the ingress of debris and fluid may result in longer service life for the rotatable cutters. As described above, extending the service life of a rotatable cutter may result in a significant cost savings for downhole earth boring operations using rotatable cutters.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A rotatable cutter for use on an earth-boring tool in a subterranean borehole, comprising:

a rotatable element comprising a cutting surface over a support structure; and a stationary element comprising a cavity, the rotatable element disposed at least partially within the cavity, the rotatable element configured to rotate relative to the stationary element about a longitudinal axis of the rotatable cutter and translate along the longitudinal axis of the rotatable cutter; and at least one seal positioned between the rotatable element and the stationary element and fixed to the rotatable element, the at least one seal configured to maintain a substantially constant sealed volume defined between the rotatable element and the stationary element, the substantially constant sealed volume configured to contain a fluid.

2. The rotatable cutter of claim 1, wherein the at least one seal further comprises a first seal positioned along the longitudinal axis at a first location proximate the cutting surface of the rotatable element and a second seal positioned at a second location positioned relatively further away from the cutting surface of the rotatable element.

3. The rotatable cutter of claim 2, wherein both the first seal and the second seal are both at least partially fixed to the rotatable element.

4. The rotatable cutter of claim 2, wherein each of the first seal and the second seal comprises an at least partially annular shape having substantially the same diameter.

5. The rotatable cutter of claim 1, wherein the substantially constant sealed volume configured to contain a substantially incompressible lubricating fluid.

6. The rotatable cutter of claim 1, wherein the at least one seal comprises a fixed seal coupled to the rotatable element and an expandable seal coupled to the stationary element.

7. The rotatable cutter of claim 6, wherein the expandable seal comprises a diaphragm extending between the stationary element and the rotatable element and fixed to the stationary element, the expandable seal comprising a resilient material configured to maintain the substantially constant sealed volume defined by the fixed seal and the diaphragm when the rotatable element moves relative to the stationary element.

8. The rotatable cutter of claim 1, further comprising:

a fluid reservoir in fluid communication with the substantially constant sealed volume; and a piston configured to maintain the substantially constant sealed volume when the rotatable element moves relative to the stationary element.

9. The rotatable cutter of claim 1, wherein the rotatable element is configured to rotate about the longitudinal axis of the rotatable cutter responsive to the translation of the rotatable element along the longitudinal axis of the rotatable cutter.

10. An earth-boring tool, comprising:

a tool body; and elements carried by the tool body, at least one element of elements comprising:

a movable element comprising a surface configured to engage a portion of a subterranean borehole; and a sleeve element, the movable element configured to rotate relative to the sleeve element about a longitudinal axis and translate relative to the sleeve element along the longitudinal axis of the movable element; and a seal arrangement between the movable element and the sleeve element the seal arrangement configured to define and maintain a substantially constant volume configured to enclose a lubricating fluid, wherein the seal arrangement comprises at least one fixed seal coupled to only one of the movable element or the sleeve element and at least one expandable seal coupled to the sleeve element.

11. The earth-boring tool of claim 10, further comprising an index positioning feature positioned between the movable element and the sleeve element, the index positioning feature configured to rotate the movable element relative to the sleeve element when the movable element is moved from a first axial position toward a second axial position and when the movable element is moved from the second axial position toward the first axial position.

12. The earth-boring tool of claim 11, wherein the seal arrangement is configured to seal at least a majority of the index positioning feature within the substantially constant volume.

13. The earth-boring tool of claim 12, further comprising an external fluid reservoir in fluid communication with the substantially constant sealed volume, the external fluid reservoir comprising at least one feature configured to maintain the substantially constant sealed volume when the movable element moves relative to the sleeve element.

14. The earth-boring tool of claim 11, wherein the index positioning feature is positioned in the substantially constant volume defined by the seal arrangement.

15. The earth-boring tool of claim 10, wherein the at least one fixed seal of the seal arrangement is fixed to the movable element.

16. The earth-boring tool of claim 15, wherein the at least one expandable seal comprises a diaphragm coupled to the sleeve element.

17. The earth-boring tool of claim 15, wherein the at least one fixed seal and the at least one expandable seal are coupled to the movable element at locations having a substantially similar diameter.

18. The earth-boring tool of claim 10, wherein each of the at least one fixed seal and the at least one expandable seal have the same diameter.

19. A method of sealing a rotatable cutting element on an earth-boring tool for use in a subterranean borehole, the method comprising:

translating an inner cutting element at least partially disposed in an outer sleeve between a first axial position and a second axial position along a longitudinal axis of the cutting element with an indexing component;

rotating the inner cutting element as the inner cutting element is translated between the first axial position or the second axial position with the indexing component; and defining a substantially constant volume around the indexing component between the inner cutting element and the outer sleeve with a sealing arrangement.

20. The method of claim 19, further comprising maintaining the substantially constant volume with the sealing arrangement comprising a first seal positioned along the longitudinal axis at a first location proximate an exposed surface of the inner cutting element and a second seal positioned second location positioned relatively further away from the exposed surface of the inner cutting element.

21. The method of claim 19, further comprising lubricating at least one inner component of the rotatable cutting element with lubricating fluid disposed in the substantially constant volume.

* * * * *